US009520010B1

(12) United States Patent
Hubbard

(10) Patent No.: US 9,520,010 B1
(45) Date of Patent: Dec. 13, 2016

(54) DECORATIVE GLASS PANEL FOR GARAGE DOOR

(71) Applicant: Benessa Hubbard, Chesapeake, VA (US)

(72) Inventor: Benessa Hubbard, Chesapeake, VA (US)

( * ) Notice: Subject to any disclaimer, the term of this patent is extended or adjusted under 35 U.S.C. 154(b) by 0 days.

(21) Appl. No.: 14/697,686

(22) Filed: Apr. 28, 2015

(51) Int. Cl.

| | |
|---|---|
| ***E05F 15/20*** | (2006.01) |
| ***G07C 9/00*** | (2006.01) |
| ***E05F 15/73*** | (2015.01) |
| ***E05F 15/77*** | (2015.01) |
| ***E05B 47/00*** | (2006.01) |
| ***E06B 3/70*** | (2006.01) |
| ***E06B 3/28*** | (2006.01) |

(52) U.S. Cl.
CPC ..... *G07C 9/00158* (2013.01); *E05B 47/00* (2013.01); *E05F 15/73* (2015.01); *E05F 15/77* (2015.01); *E06B 3/28* (2013.01); *E06B 3/7001* (2013.01); *E05B 2047/0048* (2013.01); *E05B 2047/0072* (2013.01); *E05F 2015/765* (2015.01); *E06B 2003/7044* (2013.01); *E06B 2003/7046* (2013.01); *E06B 2003/7049* (2013.01)

(58) Field of Classification Search
CPC ..... E06B 3/28; E06B 3/7001; E06B 3/54; E06B 2003/7044; E06B 1/522
See application file for complete search history.

(56) References Cited

U.S. PATENT DOCUMENTS

| | | | | |
|---|---|---|---|---|
| 1,678,439 | A | 7/1928 | Georges Le Roy | |
| 1,686,809 | A * | 10/1928 | Grau | E06B 3/68 428/38 |
| 2,956,314 | A * | 10/1960 | Rowe | E06B 3/68 160/201 |
| 3,064,380 | A * | 11/1962 | Baut | C03C 17/00 156/108 |
| 3,178,776 | A * | 4/1965 | Stansberry | E06B 3/7001 160/201 |
| 3,440,786 | A * | 4/1969 | Weaver | E04C 2/386 160/117 |
| 3,512,320 | A * | 5/1970 | Ferron et al. | B44C 5/08 428/32 |
| 4,343,758 | A * | 8/1982 | Goralnik | B29C 65/70 264/254 |
| 4,567,931 | A * | 2/1986 | Wentzel | B60J 5/125 160/232 |

(Continued)

FOREIGN PATENT DOCUMENTS

CN 101086195 12/2007

*Primary Examiner* — Katherine Mitchell
*Assistant Examiner* — Johnnie A Shablack

(57) ABSTRACT

The decorative glass panel for garage door is a sectional garage door with a fingerprint scanner. The sectional garage door is formed from a plurality of door panels. Each of the plurality of door panels have been formed with decorative designs intended to make each panel visually appealing. Associated with the decorative glass panel for garage door is an entry scanner that is allows for access into the garage without the use of a remote control. The decorative design of the scanner housing is coordinated with the design of each of the plurality of door panels which enhances the overall decorative appeal of the decorative glass panel for garage door. The decorative glass panel for garage door comprises a plurality of door panels and an entry scanner.

1 Claim, 4 Drawing Sheets

(56) References Cited

U.S. PATENT DOCUMENTS 4,569,383 A * 2/1986 Wentzel ..... E05D 15/242 160/201
5,123,211 A * 6/1992 Schlicht ..... E06B 3/685 29/449
5,189,862 A * 3/1993 Lafleur ..... E06B 3/2605 52/204.593
5,333,428 A * 8/1994 Taylor ..... B44C 5/08 264/254
5,345,743 A * 9/1994 Baier ..... E06B 3/6604 52/314
5,477,647 A * 12/1995 Yates, Jr. ..... E06B 3/6604 40/572
5,494,715 A * 2/1996 Glover ..... B44F 1/063 156/107
5,497,588 A * 3/1996 Martin ..... E06B 3/72 52/208
5,501,888 A * 3/1996 Hanson ..... B44C 5/08 156/100
5,622,019 A * 4/1997 Dorough, Jr. ..... C03B 13/08 52/308
5,644,645 A * 7/1997 Osuga ..... G06T 9/00 358/435
5,644,881 A * 7/1997 Neilly ..... E06B 3/5892 49/505
5,765,325 A * 6/1998 DeBlock ..... E06B 3/5892 52/171.1
6,131,345 A 10/2000 Pelusio
6,141,925 A * 11/2000 Halvorson, Jr. ..... E04B 2/7455 52/126.3
6,272,801 B1 * 8/2001 Suh ..... E06B 3/5892 49/505
D448,090 S 9/2001 Mock
6,524,674 B1 2/2003 Eichhorn
6,574,935 B2 * 6/2003 Wang Chen ..... E06B 3/5892 52/204.62
6,761,946 B2 * 7/2004 Corapi ..... B44C 5/0407 428/38
6,817,146 B2 * 11/2004 Jasperson ..... E06B 3/6604 52/204.59
D513,534 S * 1/2006 Barnard ..... D25/103
7,010,888 B2 * 3/2006 Tumlin ..... E06B 3/5892 52/204.56
7,107,736 B2 * 9/2006 Barnard ..... E06B 3/5892 52/204.54
7,370,682 B2 5/2008 Wong
7,430,836 B2 * 10/2008 Sibbett ..... E06B 3/5892 52/204.54
7,642,895 B2 * 1/2010 Fitzgibbon ..... B60R 25/00 340/5.26
7,698,863 B2 4/2010 Forsland
7,730,678 B2 * 6/2010 Czapka ..... B44C 5/0407 428/34
7,971,623 B2 * 7/2011 Barnard ..... E06B 3/485 160/116
8,627,871 B2 * 1/2014 Aquilina ..... E05F 15/59 160/188
8,640,414 B2 * 2/2014 Reyes, II ..... E06B 3/485 160/219
8,813,442 B1 * 8/2014 Edwards ..... E06B 3/5892 52/204.5
9,022,091 B2 * 5/2015 Shives ..... E06B 3/485 160/201
9,140,052 B2 * 9/2015 Stanislavsky ..... E06B 3/6604
2003/0198790 A1 * 10/2003 Bourassa ..... B44C 1/105 428/195.1
2006/0062436 A1 3/2006 Chen
2007/0175602 A1 * 8/2007 Ni ..... E05D 15/242 160/201
2007/0240371 A1 * 10/2007 Clifford ..... E06B 3/02 52/208
2007/0272371 A1 11/2007 Reyes
2008/0163572 A1 7/2008 Lee

* cited by examiner

DECORATIVE GLASS PANEL FOR GARAGE DOOR

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of doors, closures and latches, more specifically, a panel configured for use with a garage door.

SUMMARY OF INVENTION

The decorative glass panel for garage door is a sectional garage door with a fingerprint scanner. The sectional garage door is formed from a plurality of door panels. Each of the plurality of door panels have been formed with decorative designs intended to make each panel visually appealing. Associated with the decorative glass panel for garage door is an entry scanner that is allows for access into the garage without the use of a remote control. The decorative design of the scanner housing is coordinated with the design of each of the plurality of door panels, which enhances the overall decorative appeal of the decorative glass panel for garage door.

These together with additional objects, features and advantages of the decorative glass panel for garage door will be readily apparent to those of ordinary skill in the art upon reading the following detailed description of the presently preferred, but nonetheless illustrative, embodiments when taken in conjunction with the accompanying drawings.

In this respect, before explaining the current embodiments of the decorative glass panel for garage door in detail, it is to be understood that the decorative glass panel for garage door is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the decorative glass panel for garage door.

It is therefore important that the claims be regarded as including such equivalent construction insofar as they do not depart from the spirit and scope of the decorative glass panel for garage door. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
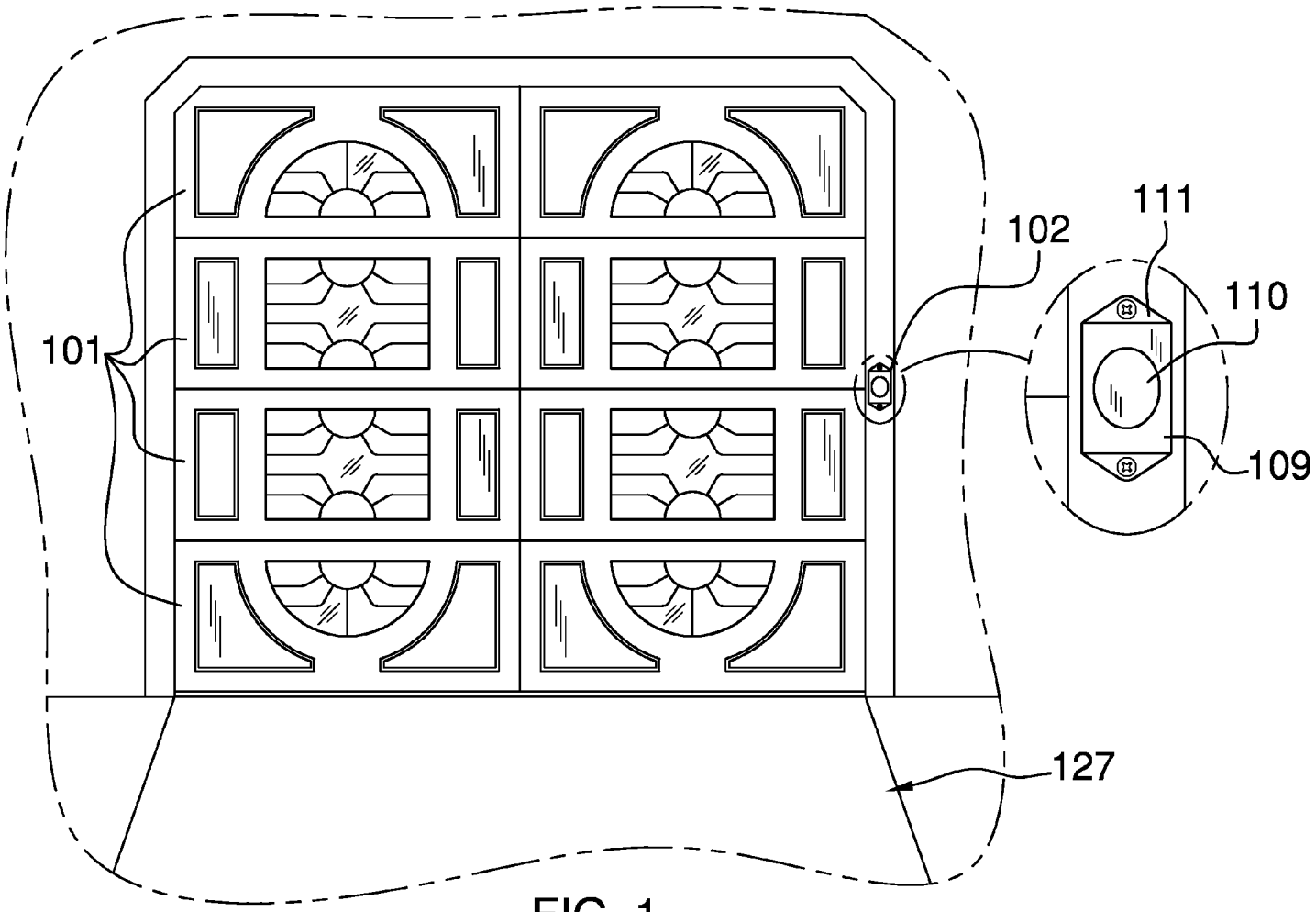
FIG. 1 is a front view of an embodiment of the disclosure.
Figure 2:
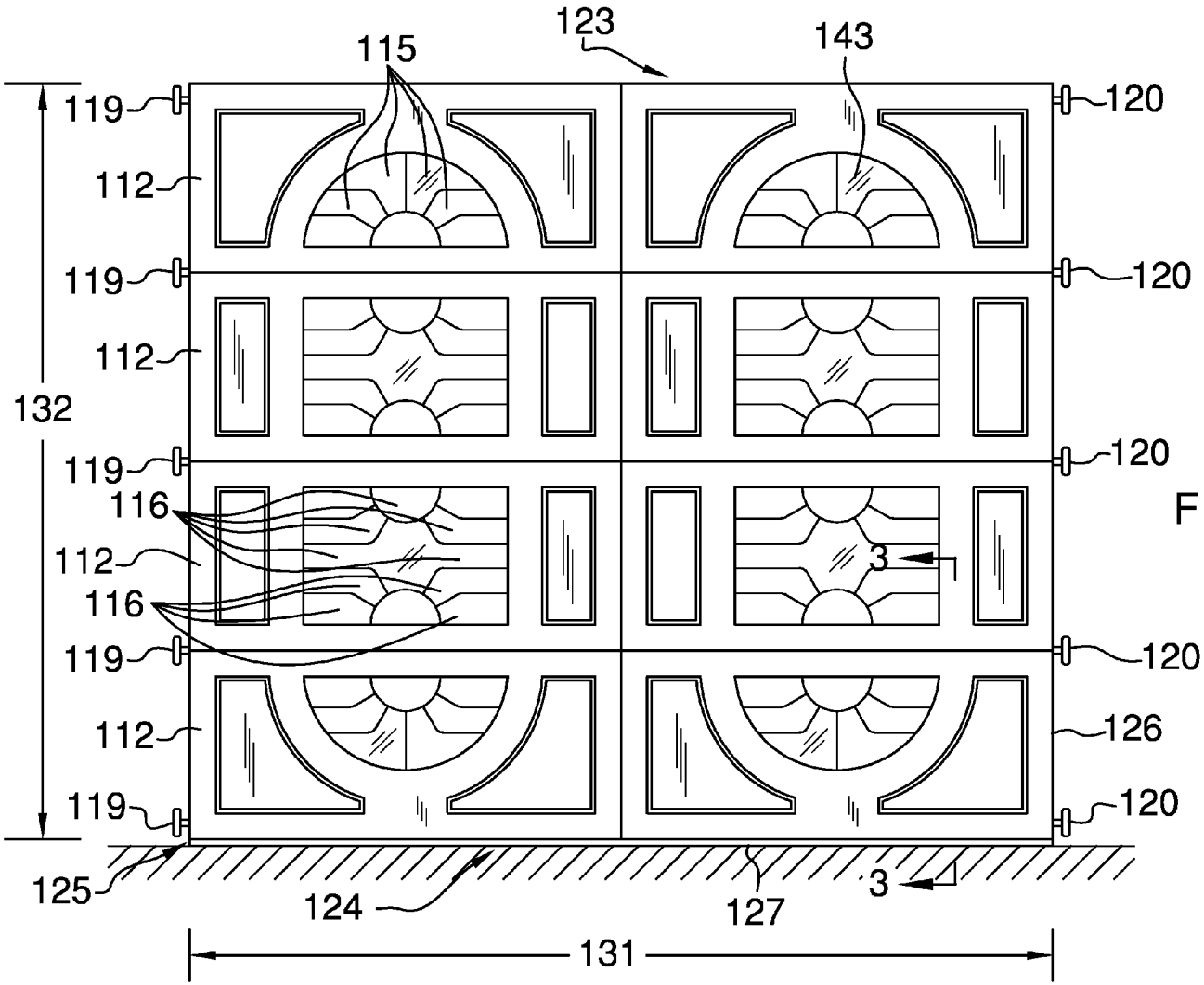
FIG. 2 is a detail view of an embodiment of the disclosure.
Figure 3:
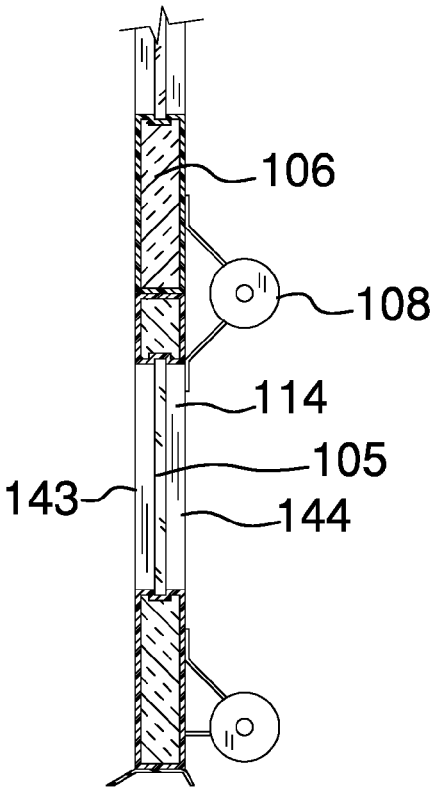
FIG. 3 is a cross-sectional view of an embodiment of the disclosure across 3-3.
Figure 4:
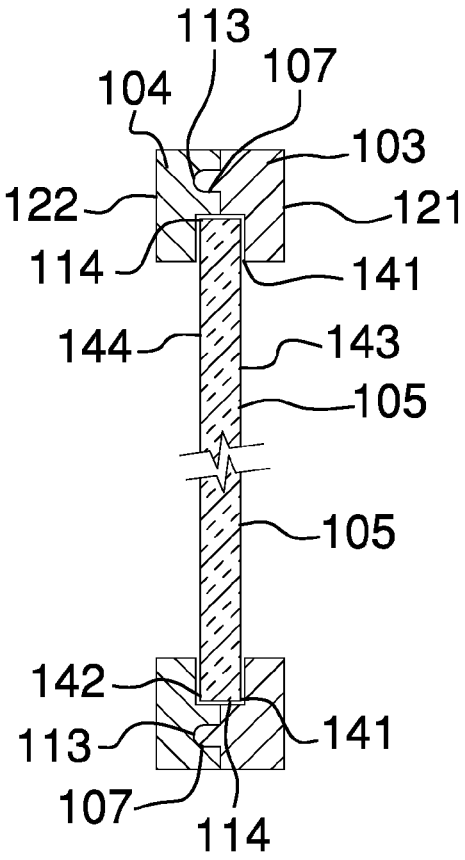
FIG. 4 is a detail view of an embodiment of the disclosure.
Figure 5:
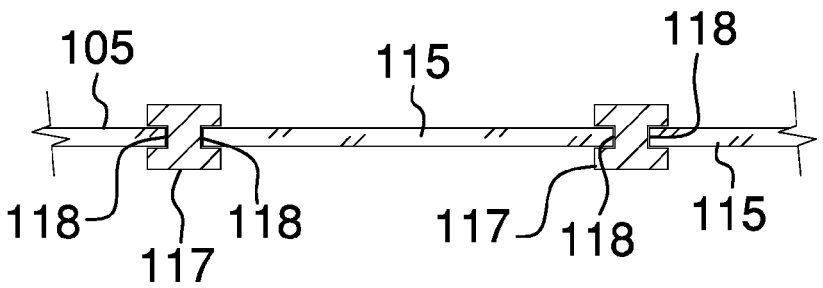
FIG. 5 is a detail view of an embodiment of the disclosure.
Figure 6:
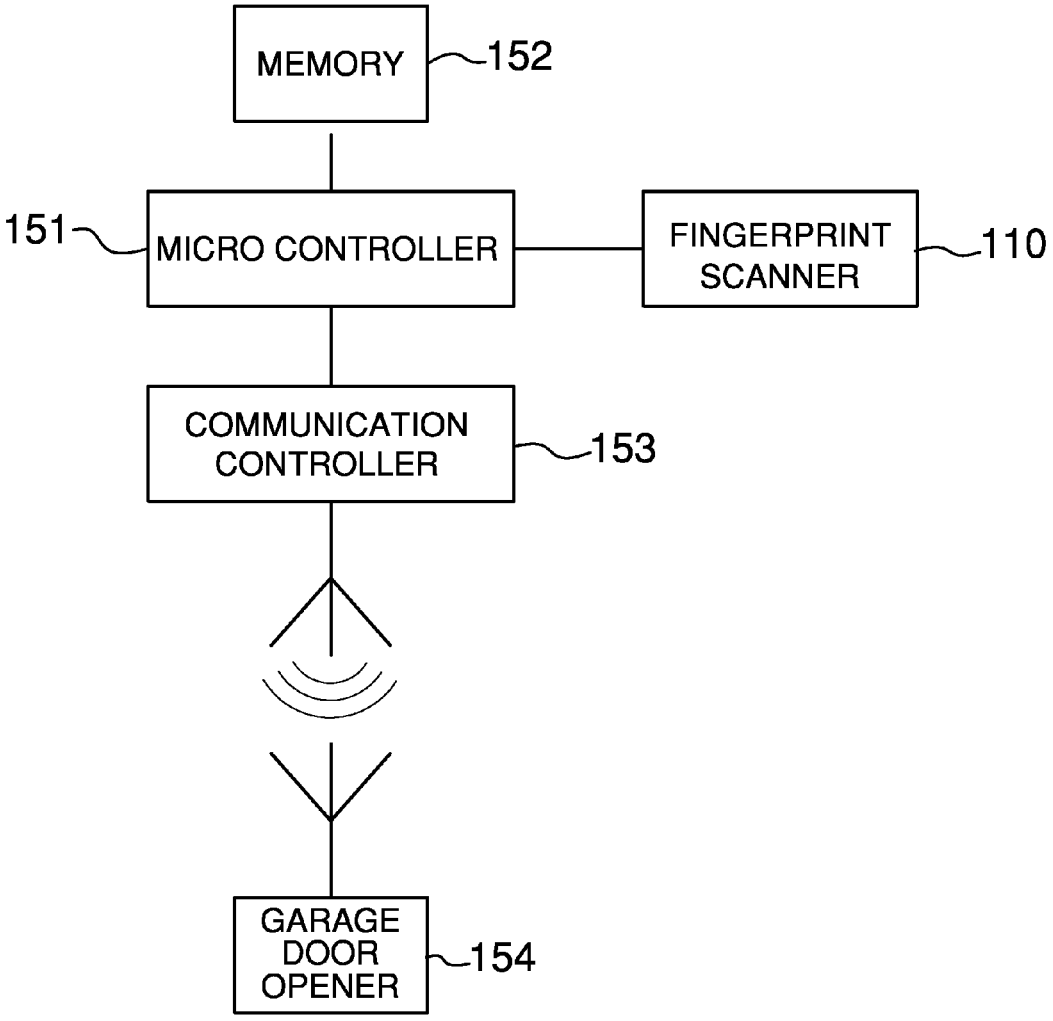
FIG. 6 is a block diagram of an embodiment of the disclosure.

Detailed reference will now be made to a first potential embodiment of the disclosure, which is illustrated in FIGS. 1 through 6. The decorative glass panel for garage door 100 (hereinafter invention) comprises a plurality of door panels 101 and an entry scanner 102.

The plurality of door panels 101 further comprises a collection of individual door panels 112. Each of the individual door panels 112 comprise an outer panel 103, an inner panel 104, a glass panel 105, optional insulation 106, a plurality of connectors 107, a plurality of connector holes 113, and a plurality of rollers 108. The individual door panel 112 is a rectangular structure that forms a portion of the sectional garage door. The dimensions of the rectangular structure is selected to accommodate the standard sectional garage door reference dimensions of 8, 12, 16 or 20 feet in width 131 by 7 or 8 feet in height 132. The reference width 131 of each of the plurality of door panels 101 is selected from a group of reference widths 131 consisting of 4 feet or 8 feet. The reference height 132 of each of the door panels is selected from a group of reference heights 132 consisting of 1.75 feet or 2 feet. The plurality of door panels 101 are connected by hinges to form the garage door.

The outer panel 103 is a rectangular structure with the same dimensions as each of the plurality of door panels 101. The outer panel 103 provides the exterior 121 surface of the individual door panel 112. The outer panel 103 has formed in it one or more third decorative openings 143 that allow viewers to see through the outer panel 103. The interior 122 side of the outer panel 103 is formed with a plurality of connectors 107 which will be used to attach the outer panel 103 to the inner panel 104. The interior 122 of the outer panel 103 is also formed with a first depression 141 which will be used to form the glass panel channel 114.

The inner panel 104 is a rectangular structure with the same dimensions as each of the plurality of door panels 101. The inner panel 104 provides the interior 122 surface of the individual door panel 112. The inner panel 104 has formed in it one or more fourth decorative openings 144 that allow viewers to see through the inner panel 104. The exterior 121 surface of each of the one or more fourth decorative openings 144 are formed as mirror image of the interior 122 surface of the corresponding opening from the one or more third decorative opening 143. This is done so that when the outer panel 103 and the inner panel 104 are joined, the one or more third decorative openings 143 and the one or more fourth decorative openings 144 appear as a single opening. The exterior 121 side of the inner panel 104 is formed with a plurality of connector holes 113 which will be used to attach the outer panel 103 to the inner panel 104. The exterior 121 of the inner panel 104 is also formed with a second depression 142 which will be used to form the glass panel channel 114.

The first depression 141 and the second depression 142 are formed as mirror images of each other. When the outer panel 103 and the inner panel 104 are joined, the first depression 141 and the second depression 142 forms the glass panel channel 114 which is the cavity that contains the glass panel 105.

The glass panel 105 further comprises a plurality of transparent pieces 115 and a framework 116. Each of the plurality of transparent pieces 115 is a piece of material that allows light to pass through it so that the objects behind the material can be perceived though not necessarily clearly seen. The framework 116 is similar to that used in the Came Glasswork traditionally used in stained glass. The framework 116 both holds each of the plurality of transparent pieces 115 in place. The framework 116 is made from a plurality of cames 117. Each of the plurality of cames 117 is a metal bar the when look at from the end is formed with two channels 118 that for an "H." Each channel 118 in each of the plurality of cames 117 receives an edge from a transparent piece selected from the plurality of transparent pieces 115. The purpose of the framework 116 is: 1) decorative; and, 2) to support the weight of heavier transparent pieces that may be included in the plurality of transparent pieces 115. Methods of building frameworks and inserting and supporting transparent materials in a framework are well known and documented in the art.

The plurality of connectors 107 are a collection of posts that extend away from the interior 122 side of the outer panel 103. The plurality of connector holes 113 are a collection of holes that are formed on the exterior 121 side of the inner panel 104. Each of the plurality of connector holes 113 are sized to receive a connector selected from the plurality of connectors 107. Each of the plurality of connector holes 113 is placed in a position that corresponds to the position of a selected connector from the plurality of connectors 107.

The plurality of rollers 108 comprises a left roller 119 and a right roller 120. The left roller 119 is positioned on the left 125 side of the individual door panel 112. The right roller 120 is positioned on the right 126 side of the individual door panel 112. The left roller 119 and the right roller 120 are sized to be received in the left 125 garage door track and the right 126 garage door track respectively and are used to raise and lower the invention 100.

Each individual door panel 112 can also be fitted with optional insulation 106. This can be accomplished by using a hollow outer panel 103 and a hollow inner panel 104 wherein the hollow spaces of both the outer panel 103 and the inner panel 104 are filled with insulating material. Alternately, or in addition to the above, once the individual door panel 112 is completed, any hollow spaces between the outer panel 103 and the inner panel 104 can be filled with insulation 106.

The entry scanner 102 further comprises a wireless entry pad 109, a fingerprint scanner 110, and an entry scanner housing 111. The purpose of the entry scanner 102 is to open or close the invention 100 initiated by the recognition of the fingerprint of a finger that is place in the fingerprint scanner 110. The purpose of the fingerprint scanner 110, is to scan the fingerprint of the finger placed in the fingerprint scanner 110. The purpose of the wireless entry pad 109 is to receive the scanned image of the fingerprint, verify that the scanned image of the fingerprint matches a fingerprint authorized to open or close the invention 100, and once the fingerprint is verified to send a signal to open or close the door. The entry scanner housing 111 is a decorative rigid container that is used to contain the wireless entry pad 109 and the fingerprint scanner 110. The decorative motif of the entry scanner housing 111 is selected to match, supplement, or enhance the aesthetic quality of each of the plurality of door panels 101.

The functionality of the wireless entry pad 109 can be accomplished in two manners. In the first manner, a microcontroller 151, memory device 152, and a communication controller 153 are configured for use with the finger print scanner. The microcontroller 151 receives the scanned fingerprint image and compares it to fingerprints stored in the memory device 152. If a received fingerprint is verified, the communication controller 153 then sends a signal to the garage door opener 154 to open the invention 100. In the second manner, the wireless entry pad 109 is configured to wirelessly relay the scanned fingerprint image to a secured computer that verifies the fingerprint and sends the open command wirelessly to the garage door opener 154 to open the invention 100.

In the first potential embodiment of the disclosure, the inner panel 104 and outer panels 103 are made of fiberglass. The glass panel 105 is formed from traditional glass mounted in an aluminum frame. The plurality of connectors 107 and the plurality of connector holes 113 are formed as part of the outer panel 103 and the inner panel 104 respectively. The plurality of rollers 108 are commercially available. Fingerprint scanners 110, including wireless and Bluetooth fingerprint scanners, are commercially available. In the first manner, a keyless entry pad commonly available with garage door openers 154 is adapted to work with a fingerprint scanner 110. The resulting device is mounted in the entry scanner housing 111. In the second manner, a wireless fingerprint scanner 110 is mounted in the entry scanner housing 111 and is linked to the secured computer. Readily and commercially available garage door openers 154 exist that offer internet connections to allow authorized users access for remote operation. Once the secured computer has verified the fingerprint, the secured computer is configured to send via the internet the remote open command.

In subsequent potential embodiments of the disclosure, the inner panel 104 and outer panels 103 can molded from plastics including, but not limited to, polyvinylchloride or polyethylene. The plurality of transparent pieces 115 can be made from several types materials including, but not limited to, beveled glass, stained glass thermal glass, frosted glass or transparent polycarbonate. Alternatively, transparent panels can be placed directly in the glass panel channel 114. The glass panels 105 can be made from several types materials including, but not limited to, beveled glass, stained glass thermal glass, frosted glass or transparent polycarbonate.

The following definition and directional references were used in this disclosure.

Reference Dimension: As used in this disclosure, a reference dimension is the designation of a dimension that approximates the actual dimension of an object in a standardized manner. As an example, the piece of lumber sold as a "two by four" has the reference dimensions of two inches by four inches while the actual dimensions are 1.5 inches by 3.5 inches. The difference between reference dimension and actual dimension is often driven by subsequent finishing steps that may be applied to the object.

Directional References: The directional references of this disclosure correspond to a observer standing outside of a garage looking directly at the garage door. The interior 122 refers to the side of an object that is distal to the observer. The exterior 121 refers to the side of an object that is distal from the interior 122 side of the same object. Upper 123 refers to the side of an object that is distal from the ground 127. Lower 124 refers to the side of an object is distal from the upper 123 side of the same object. Left 125 refers to the side of an object that is to the left 125 side of the observer. Right 126 refers to the side of an object that is to the right 126 side of the observer.

With respect to the above description, it is to be realized that the optimum dimensional relationship for the various components of the invention described above and in FIGS. 1 through 6, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

Is shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A decorative door comprising:

a plurality of door panels and an entry scanner;

wherein the decorative door is adapted for use as a garage door;

wherein a portion of one or more of the plurality of door panels allows light to pass through;

wherein the entry scanner is used to open and close the decorative door;

wherein the entry scanned is initiated through the use of a fingerprint;

wherein the plurality of door panels further comprises a collection of individual door panels;

wherein each of the individual door panels comprises an outer panel, an inner panel, a glass panel, a plurality of connectors, a plurality of connector holes, and a plurality of rollers;

wherein the outer panel of each of the plurality of door panels has at least one decorative opening formed therein;

wherein an interior side of the outer panel of each of the plurality of door panels is formed with the plurality of connectors;

wherein the interior side of the outer panel of each of the plurality of door panels is formed with a first depression;

wherein the inner panel of each of the plurality of door panels has at least one decorative opening formed therein;

wherein the exterior side of each of the one or more fourth decorative openings are formed as mirror image of the interior surface of the corresponding opening from the one or more third decorative opening;

wherein the exterior side of the inner panel of each of the plurality of door panels is formed with the plurality of connector holes;

wherein the exterior side of the inner panel of each of the plurality of door panels has a second depression;

wherein upon joining the outer panel and the inner panel, the first depression of the outer panel of each of the plurality of door panels and the second depression of the inner panel of each of the plurality of door panels form a glass panel channel;

wherein the glass panel of each of the plurality of door panels is inserted into the glass panel channel;

wherein the glass panel of each of the plurality of door panels further comprises a plurality of transparent pieces and a framework;

wherein each of the plurality of transparent pieces are each further defined as a piece of material that allows light to pass there through;

wherein the framework comprises a plurality of cames;

wherein each of the plurality of cames is a bar formed with two channels;

wherein at least one channel in each of the plurality of cames receives an edge from a transparent piece selected from the plurality of transparent pieces;

wherein the plurality of connectors are a collection of posts that extend away from the interior side of the outer panel;

wherein the plurality of connector holes are a collection of holes that are formed on the exterior side of the inner panel;

wherein each of the plurality of connector holes are sized to receive a connector selected from the plurality of connectors;

wherein each of the plurality of connector holes is placed in a position that corresponds to the position of a selected connector from the plurality of connectors;

wherein the outer panel is attached to the inner panel by inserting each the plurality of connectors into one of the plurality of collector holes;

the entry scanner further comprises a wireless entry pad, a fingerprint scanner, and an entry scanner housing;

wherein the entry scanner is used to open and close the decorative door;

wherein the fingerprint scanner scans for a fingerprint;

wherein the entry scanner housing is a decorative rigid container;

wherein the wireless entry pad comprises a microcontroller, memory device, and a communication controller;

wherein the wireless entry pad receives a scanned image of the fingerprint;

wherein the wireless entry pad verifies that the scanned image of the fingerprint matches a fingerprint authorized to open or close the decorative door;

wherein the wireless entry pad sends a signal to open or close the door.

* * * * *